United States Patent [19]

Boisture

[11] Patent Number: 5,031,691

[45] Date of Patent: Jul. 16, 1991

[54] MULTI-LANCE TUBE CLEANING SYSTEM HAVING SLIDING PLATE

[75] Inventor: Thomas B. Boisture, Baytown, Tex.

[73] Assignee: Ohmstede Mechanical Services, Inc., Baytown, Tex.

[21] Appl. No.: 600,484

[22] Filed: Oct. 19, 1990

Related U.S. Application Data

[63] Continuation-in-part of Ser. No. 490,776, Mar. 8, 1990, Pat. No. 5,002,120.

[51] Int. Cl.[5] ..... F22B 37/52

[52] U.S. Cl. ..... 165/95; 122/379; 122/392; 134/166 C; 134/167 C

[58] Field of Search ..... 122/379, 391, 392; 165/95; 15/316 R, 316 A, 317; 134/166 C, 167 C, 56 R

[56] References Cited

U.S. PATENT DOCUMENTS

| | | |
|---|---|---|
| 620,224 | 2/1899 | Bubser . |
| 1,694,371 | 12/1928 | Burdick . |
| 1,796,878 | 3/1931 | Watson . |
| 2,494,380 | 1/1950 | Ellig . |
| 2,604,368 | 7/1952 | Richards . |
| 3,269,659 | 8/1966 | Shelton . |
| 3,589,388 | 6/1971 | Haneline, Jr. . |
| 3,600,255 | 8/1971 | Parmelee . |
| 3,794,051 | 2/1974 | Lee, Jr. . |
| 3,817,262 | 6/1974 | Caradeur . |
| 3,901,252 | 8/1975 | Riebe . |
| 3,903,912 | 9/1975 | Ice, Jr. . |
| 3,938,535 | 2/1976 | Cradeur . |
| 4,095,305 | 6/1978 | Goodwin . |
| 4,107,001 | 8/1978 | Kinzler . |
| 4,199,837 | 4/1980 | Fisco, Jr. . |
| 4,234,980 | 11/1980 | Divito . |
| 4,322,868 | 4/1982 | Wurster . |
| 4,422,210 | 12/1983 | Bergsand . |
| 4,503,811 | 3/1985 | Hammond . |
| 4,543,711 | 10/1985 | Wada et al. . |
| 4,547,963 | 10/1985 | Ohmstede . |
| 4,856,545 | 8/1989 | Krajicek . |

OTHER PUBLICATIONS

Hydrovac Industrial & Petroleum Services Ltd. Drawings for Multi Rotating Lance Bundle Cleaner Dated Feb. 2, 1988 and Multiple Rotating Lance Bundle Cleaner Dated Feb. 2, 1988.

Dow Chemical Co. "Jet-Cleaning Heat Exchanger Tubes with Mini-Lancer Service".

"Weatherford Water Jetting Systems"-1988.

Hydrovac International Inc. "6 Lance Table Mounted Rotating Tube Cleaner".

Browning-Ferris Industries Inc. "About Cesco".

The Cesco Scene "Hydroblast Fleet Increased . . . ".

The Cesco Scene "Equipment Construction Blitz Adds Sales Leverage".

R. Lee, R. Torbin, R. Bell, "State of the Art Mechanical Cleaning of Heat Exchangers" ASME/IEEE Power Generation Conference, 10,20,85.

J. W. Twigg, "High-Pressure Water Jetting Techniques", Corrosion Prevention and Control, vol. 29, No. 2, Apr. 1982.

*Primary Examiner*—Edward G. Favors

*Attorney, Agent, or Firm*—Pravel, Gambrell, Hewitt, Kimball & Krieger

[57] ABSTRACT

A multi-lance cleaning apparatus for cleaning the interior of heat exchanger tubes, the apparatus having a lance housing, a slidable manifold within the lance housing, a single conduit connecting the manifold with a high pressure, high volume, fluid source, a hose enclosure for enclosing the high pressure water hose permitting the hose to advance and retract, means for moving the manifold within the housing, a plurality of lances removably attached to the manifold and adapted to fit within a heat exchanger tube, tube guides to guide and support the lances, and a slide plate on which the manifold is located for preventing the lances from bending and entering the hose enclosure. The apparatus may further include means for positioning and guiding the housing with respect to a heat exchanger tube bundle to be cleaned.

20 Claims, 6 Drawing Sheets

FIG. 5A
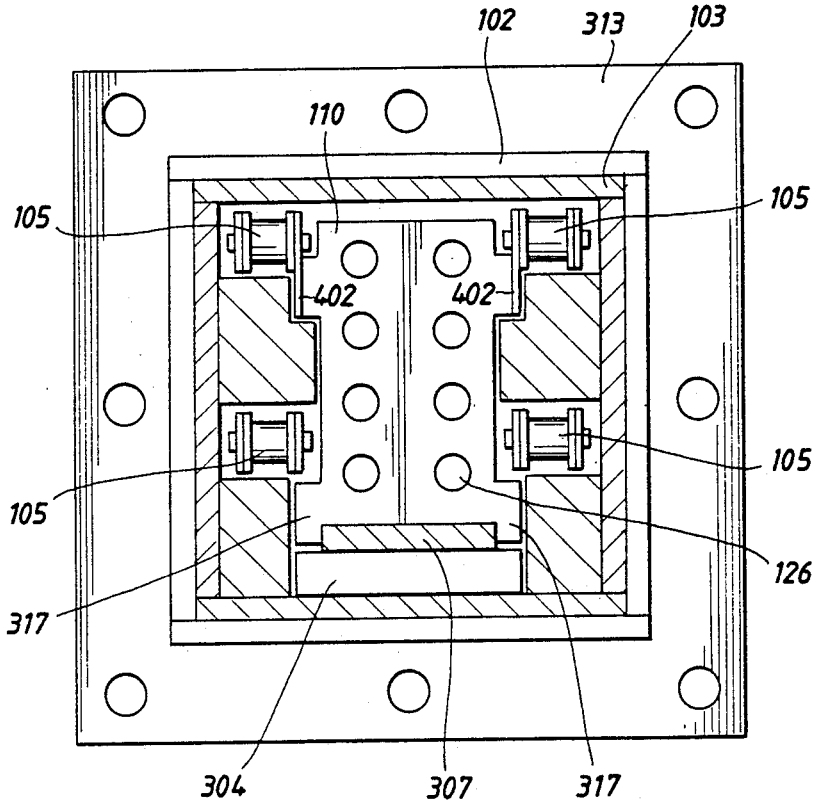
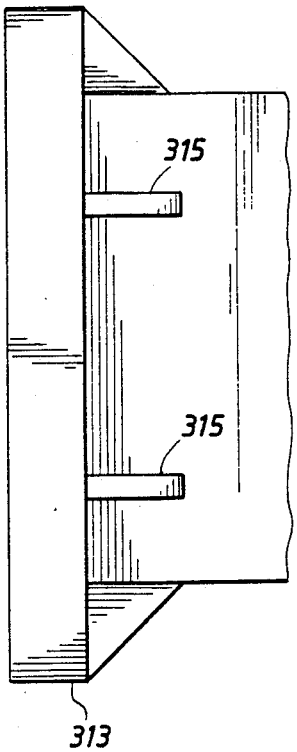
FIG. 5B
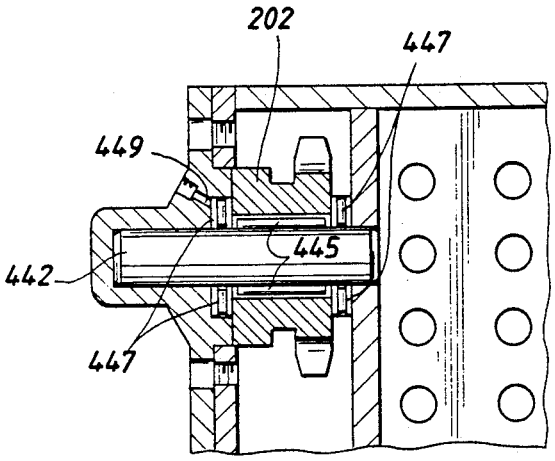
FIG. 12

FIG. 6
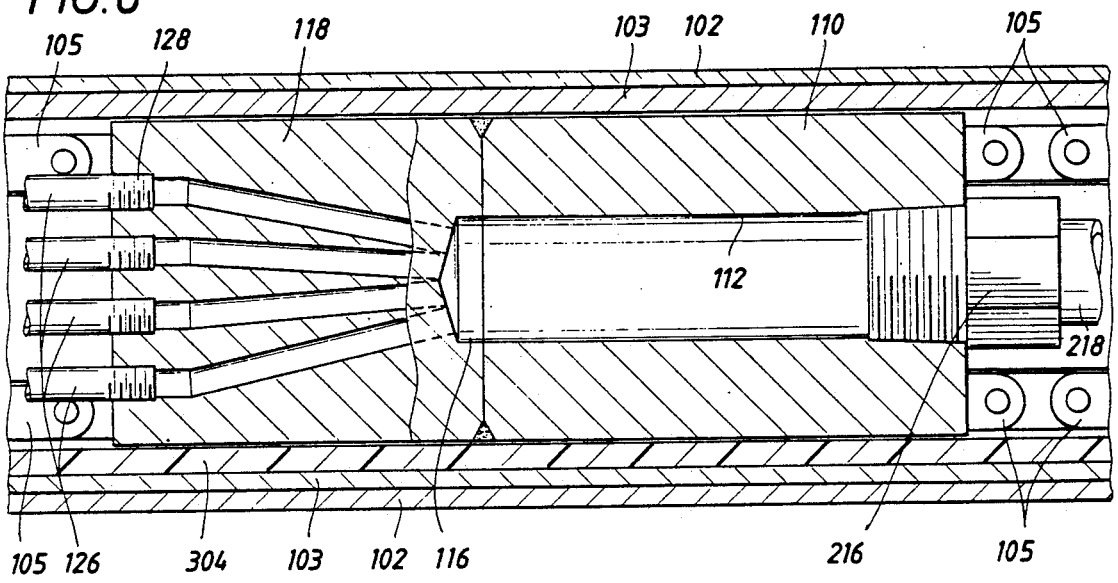
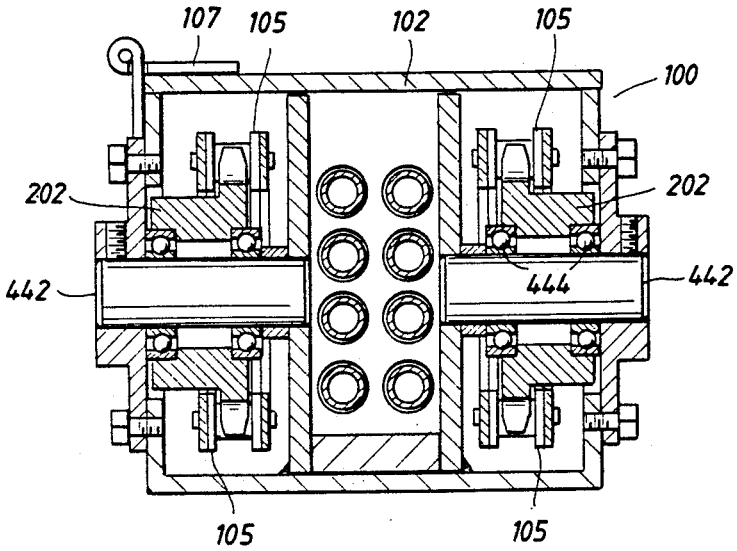
FIG. 7

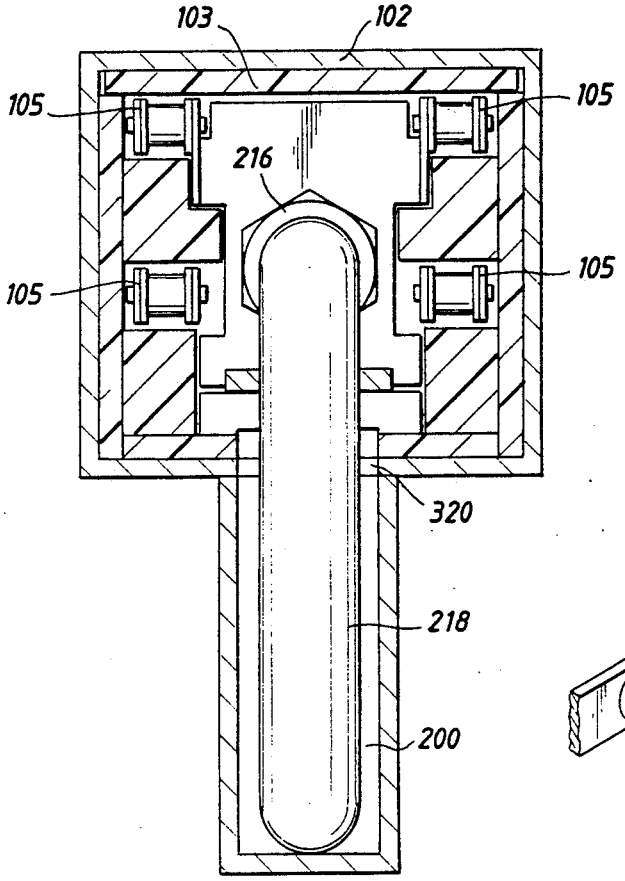
FIG. 8
FIG. 9
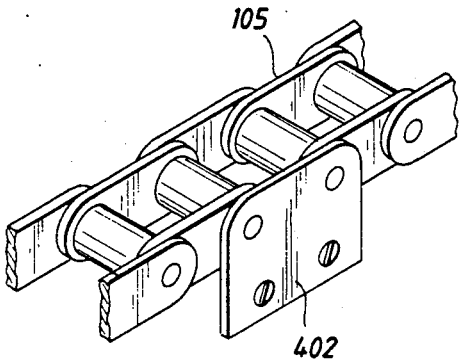
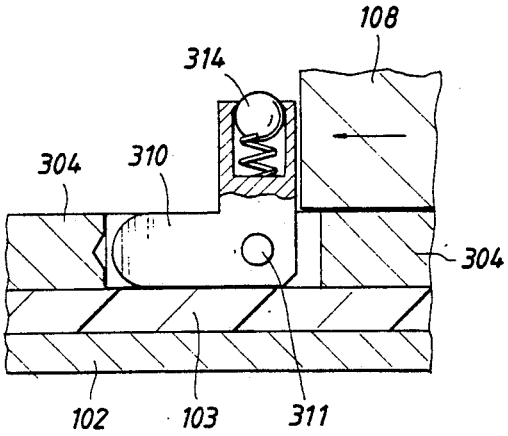
FIG. 10
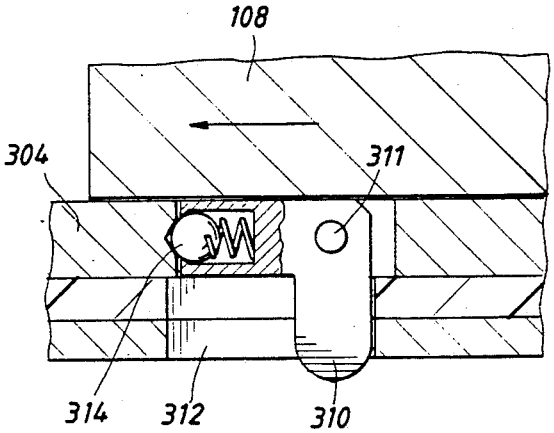
FIG. 11

MULTI-LANCE TUBE CLEANING SYSTEM HAVING SLIDING PLATE

This application is a continuation-in-part of U.S. application Ser. No. 490,776, filed Mar. 8, 1990, U.S. Pat. No. 5,002,120 for a MULTI-LANCE TUBE CLEANING SYSTEM. The inventor listed in the present application was a named inventor in application Ser. No. 490,776.

BACKGROUND OF THE INVENTION

1. Field of the Invention

The present invention relates to an apparatus for cleaning the interior of tubes used in heat exchanger bundles. More particularly, the present invention relates to an apparatus for simultaneously cleaning the interior of several tubes within a heat exchanger bundle on site.

2. Description of the Related Art

Heat exchangers are used for the transfer of heat from one fluid medium to another. One of the fluids passes through a series of conduits, or tubes, while the other passes on the outside of the tubes. During this process, carbonaceous and calcareous deposits form on the interior of the individual tubes. Debris and other dirt collects on the surface of the individual tubes. To maintain efficient operation, it is necessary to periodically remove the tubes and clean their interior and exterior surfaces.

One method of cleaning the interior of heat exchanger tubes includes the progressive insertion of a small diameter tube, known as a lance, into the heat exchanger tube and the pumping of high pressure water through the lance to clean the interior of the tube. The water pressure in a lance may easily exceed 10,000 psi with flow rates in excess of 100 gallons per minute. Prior art devices call for the lance to be manually operated, including the manual advancing of the lance into the exchanger tube. It will be appreciated that the manual operation of a lance is unsatisfactory for a number of reasons. First, the operator is required to overcome the force of the water pressure when inserting the lance into the tube. Further, should the lance wall rupture, the operator or a bystander may be injured by the high pressure water flow. An operator may also be injured as a result of back-splash from the lance during the insertion of the lance in the tube. Furthermore, the manual operation of a lance is time consuming and costly since only one lance may be used in manual operations.

Various mechanical devices have been used in an effort to overcome the above deficiencies in cleaning the interior of heat exchanger tubes. U.S. Pat. No. 3,903,912 to Ice et al. discloses a multiple lance cleaning system which includes lance positioning and drive means and which uses exposed lance tubes. The use of exposed lance tubes poses a danger to an operator in the event of a lance wall rupture.

U.S. Pat. No. 3,817,262 to Cradeur discloses a multiple lance cleaning system having a lance positioner and drive system and also uses exposed lance tubes. As in the Ice disclosure, the operator is exposed to the danger of potential lance tube rupture.

U.S. Pat. No. 3,901,252 to Riebe discloses a multiple lance system including a lance drive and enclosed lance tubes, manifold and water lines. Unlike the Ice and Cradeur lances, the lance disclosed in Riebe is enclosed. However, the Riebe apparatus features another problem in that the water inlet line is pulled in and out of the lance enclosure during operations. Such a configuration causes wear and tear on the water hose which could lead to its failure under high pressure. Furthermore, at various points in the operation, the section of the water hose subject to wear and tear can be found at least partly protruding outside the lance enclosure in a location wherein a rupture of the hose could endanger the operator.

U.S. Pat. No. 4,856,545 to Krajicek discloses a multi-lance tube cleaning system having a lance drive means, lance tubes and manifold, and multiple high pressure water lines within an enclosed structure. Unlike the apparatus taught in Riebe, the hose is not dragged in and out of the enclosure so that wear and tear on the hose is minimized. Rather, the water hose is deployed within its own protective enclosure which is located immediately below the lance enclosure. The hose is permanently attached to its protective enclosure at its point of entry. This tends to minimize the wear and tear on the hose. The protective hose enclosure serves to protect personnel in the event of a water hose rupture. However, as can be appreciated from the disclosure of the Krajicek patent, for example in FIG. 8 of that reference, the water hose leaves its own protective enclosure and enters the lance enclosure by way of a long slot which connects the two enclosures. The presence of the slot is problematical in that it makes it possible for one or more of the lances to bend and enter the slot. This allows bending of the lance which may cause it to malfunction. In addition, the lance entering the slot can contact the water hose located below the slot and cause the water hose to rupture.

Accordingly, there exists a need for an improved tube bundle cleaner having means for transporting water to the lances, means for accurately supporting and positioning the lances during operation, means for retracting the water pressure line in an efficient and thorough manner, and which also has enclosed tube lances and enclosed water hose which will prevent the lances from bending out of shape and from contacting and possibly damaging the water hose.

While there are other disclosures directed to the cleaning of the interior of heat exchanger bundles (such as U.S. Pat. Nos. 3,589,388; 2,494,380; 1,694,371; and 620,224), none discloses or suggests a multi-lance cleaning system having enclosed lances and enclosed hose wherein the lances are prevented from bending so much as to leave their enclosure and possibly enter the water hose enclosure.

SUMMARY OF THE INVENTION

The present invention relates to a multi-lance apparatus for cleaning the interior of tubes within a heat exchanger tube bundle. The apparatus features an elongate lance housing, or lance enclosure, having a slide plate which prevents the lances from bending so as to fail and which further prevents the lances from contacting the water hose. The water hose is located in a hose enclosure designed to protect personnel from a hose failure or burst. The apparatus also includes a moveable high pressure water manifold located within the lance housing, a conduit connecting the manifold to a high pressure high volume water source, and means for storing the conduit. The apparatus further includes a plurality of lances removably connected to the manifold, means for moving the manifold within the housing and means or supporting and guiding the lance tubes during operations. Also disclosed is a means for positioning and supporting the housing with respect to a tube bundle to be cleaned.

BRIEF DESCRIPTION OF THE DRAWINGS

In order to more fully understand the drawings referred to in the detailed description of the present invention, a brief description of each drawing is presented.

FIGS. 5A and 5B are cross-sectional end and side views of the lance housing including the manifold and the flange of the preferred embodiment taken along line 5—5 of FIG. 3;

FIG. 6 is a cross-sectional side view of the lance housing including the manifold of the preferred embodiment;

FIG. 7 is a cross-sectional end view of the front section of the lance housing of the preferred embodiment taken along line 7—7 of FIG. 4;

FIG. 8 is an end view of the manifold of the preferred embodiment showing the water hose and its attachment to the manifold taken along line 8—8 of FIG. 4;

FIG. 9 is a perspective view of the chain and chain attachment of the preferred embodiment.

FIG. 10 is a view of the detent of the preferred embodiment in the released position.

FIG. 11 is a view of the detent of the preferred embodiment in the locked in position.

FIG. 12 is an exploded cross-sectional end view of a portion of the front section of the lance housing of an alternative embodiment of the idler sprocket shown in FIG. 7 taken along line 7—7 of FIG. 4;

DETAILED DESCRIPTION OF THE INVENTION

Figure 1:
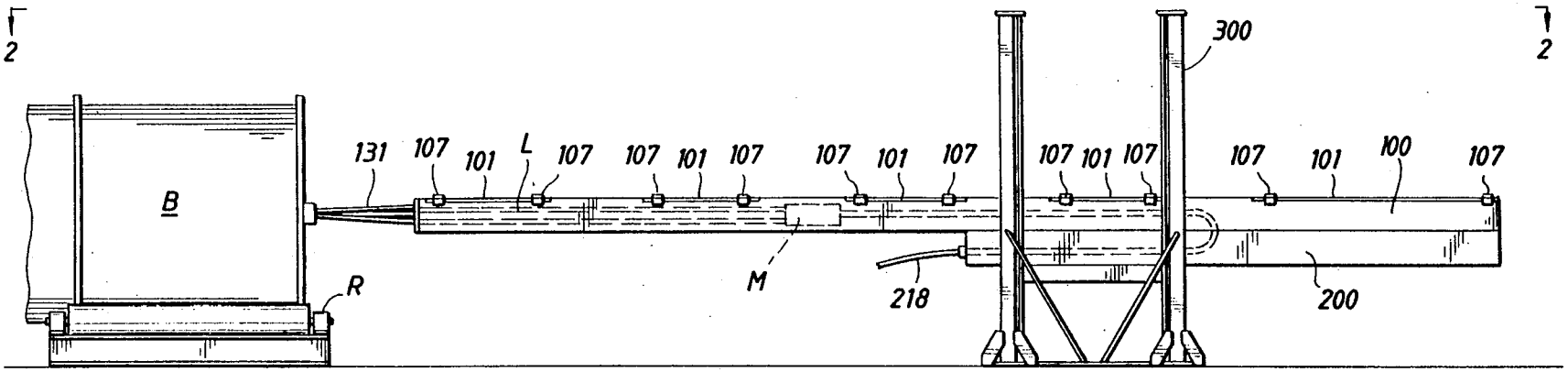
FIG. 1 is an elevational view of an apparatus according to the preferred embodiment.
Figure 2:
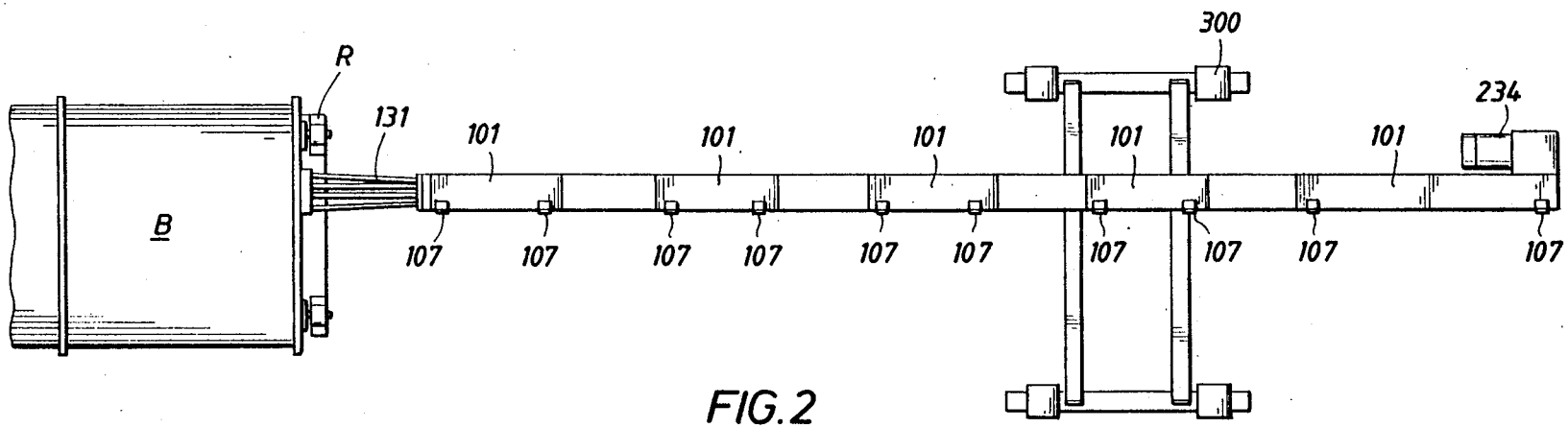
FIG. 2 is a top view of the apparatus of FIG. 1.

FIGS. 1 and 2 are side and top views, respectively, of the preferred embodiment of the apparatus according to the present invention. A tube bundle "B" is disposed on rollers which are part of a tube bundle support and rotating device "R". The device "R" is disclosed in pending U.S. patent application Ser. No. 489,001 filed Mar. 6, 1990. Lance enclosure 100 is shown in close proximity to tube bundle "B." A plurality of hollow, high strength lances "L" are generally shown as being disposed in the lance enclosure 100. A lance indexing assembly 131 is shown affixed to the end of the lance enclosure 100, adjacent to the tube bundle "B." Further, the lances "L" are shown as being in communication with a manifold "M" within the lance enclosure 100. Hose enclosure 200 is located below lance enclosure 100 near its rear end, that is, near its end farthest from the tube bundle "B". The hose enclosure 200 serves to store a high pressure flexible water line 218 which is in communication with manifold "M" in lance enclosure 100. The manifold "M" is moved by the use of chains which are driven by hydraulic motor drive 234.

Water line 218 is connected to a high pressure, high volume water source (not shown). The lance enclosure 100 and the hose enclosure 200 are supported by a positioner assembly 300 which supports and positions the lance enclosure 100 and the hose enclosure 200 relative to the tube bundle "B" to be cleaned. Positioner 300 is capable of moving lance enclosure 100 and hose enclosure 200 both horizontally (or laterally) and vertically. A detailed description of one embodiment of positioner 300 which can be used with the present invention is included in the parent of the present application, U.S. patent application Ser. No. 490,776, filed on Mar. 8, 1990, which entire disclosure is hereby incorporated by reference as if fully set forth herein. The lance enclosure 100, includes a number of covered openings 101 located at its top surface which can be uncovered to facilitate servicing the lances. The covered openings 101 can be uncovered using mounted hinges 107 (see FIG. 7).

A remote control pendant (not shown) is used to control the flow of high pressure water into the lances. The pendant is also used to control the flow of hydraulic fluid used to position the lance cleaner of the present invention. While the remote control pendant may be configured to control any suitable high pressure water source and hydraulic flow, it is contemplated that the present invention, including the remote control pendant, has been specifically configured to operate with the high pressure water source and hydraulic pressure source described in U.S. patent application Ser. No. 489,001. Further, the control pendant in the present invention is interconnected with the positioning assembly 300 in a like manner as the remote control pendant described in U.S. patent application Ser. No. 490,776.

Figure 3:
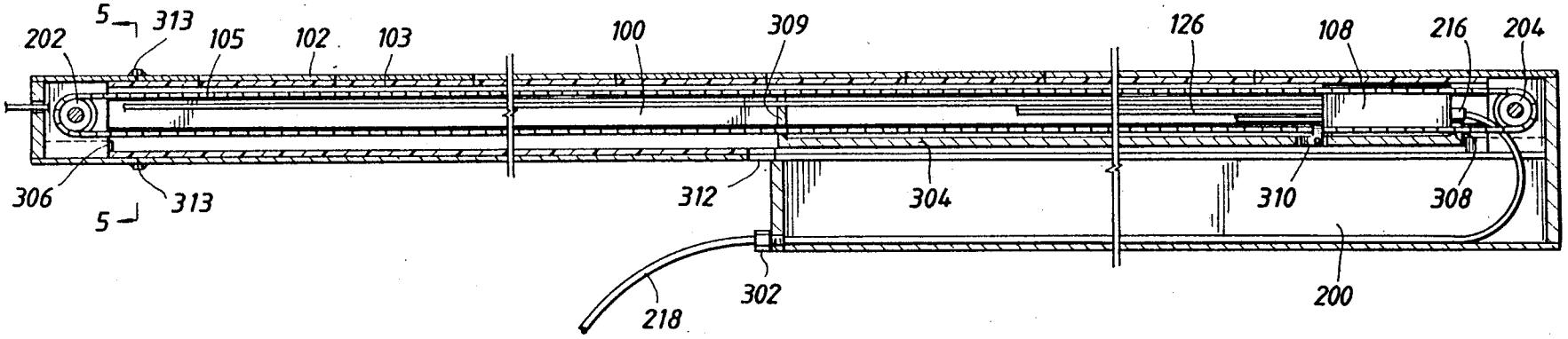
FIG. 3 is a cross-sectional view of the tube cleaning apparatus of the preferred embodiment with the lances in their fully retracted position.
Figure 4:
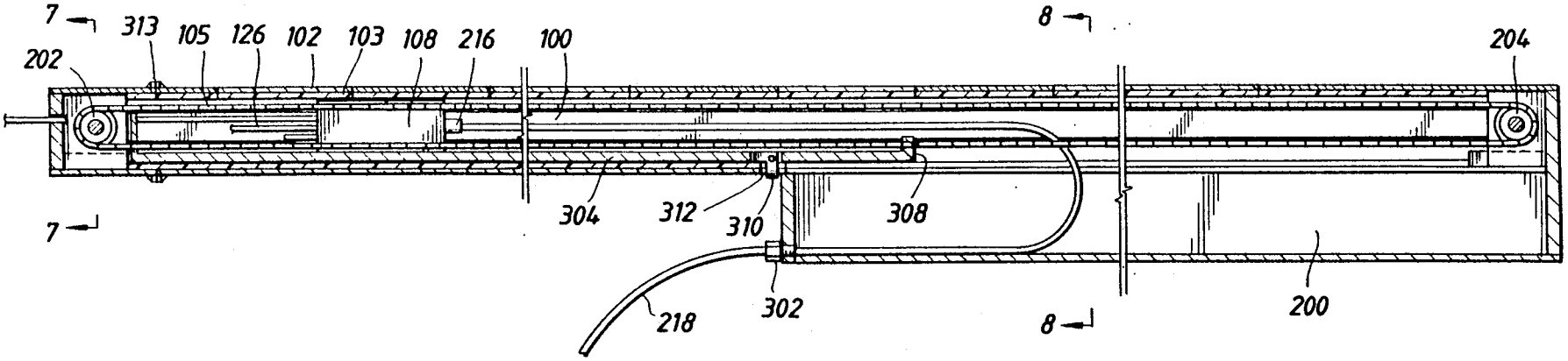
FIG. 4 is a cross-sectional view of the tube cleaning apparatus of the preferred embodiment with the lances partially retracted.
Figure 13:
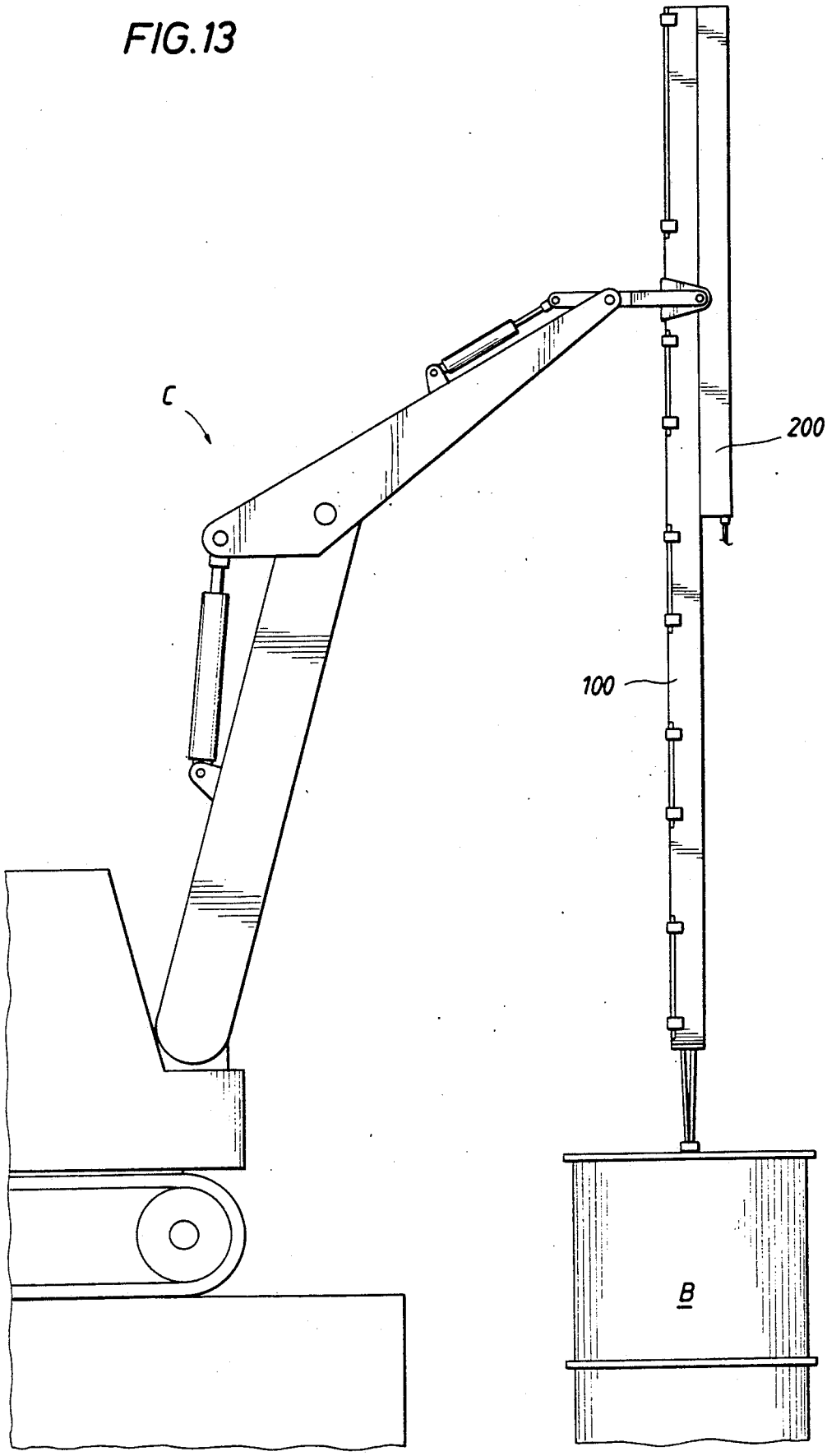
FIG. 13 is a view that shows the device of FIG. 1 suspended from a crane.

Referring now to FIGS. 3 and 4, lance enclosure 100 and hose enclosure 200 are shown in greater detail. The lance enclosure 100 includes a housing 102 which, in the preferred embodiment, is rectangular in cross-sectional shape. However, it is understood that the cross-section of housing 102 may be of any other convenient shape without departing from the spirit of the present invention. The housing 102 forms the external surface of the lance enclosure 100. Located inside the housing 102 are internal walls 103 which can be made of any convenient material, preferably of ultra high molecular weight polymer. The material of construction of the internal walls 103 is selected to give the walls sufficiently low friction to allow the sliding members of the lance enclosure 100 to slide easily back and forth.

The manifold 108 is mounted within the lance enclosure 100 so as to be slidable through virtually the entire length of the lance enclosure 100, from a location near the rear sprocket wheels 204 to a position near the front sprocket wheels 202. Attached to the front end of the manifold 108 are a plurality of lances 126. Attached to the rear portion of the manifold 108 is water hose 218 which is attached through coupling 216. The manifold 108 is attached at its sides to a pair (only one is shown) of endless drive chains 105 which ride on a pair (only one is shown) of front sprocket wheels 202 and a pair (only one is shown) of rear sprocket wheels 204. A small portion of one of chains 105 is shown in FIG. 9 which also depicts connector 402 which serves to attach chain 105 to bracket 400. Connecter 402 is attached to the upper side wall of manifold 108 (see FIG. 5). Connecter 402 may be attached to manifold 108 by any convenient means, such as by use of a screw or a bolt. In a typical application, two connecters 402 are used to connect each of chains 105 to manifold 108. A pair of connecters 402 is located near the front of manifold 108 while a second pair of connecters 402 is located toward the rear portion of manifold 108.

Manifold 108 rides on slide plate 304. To facilitate the smooth movement of manifold 108 over slide plate 304, the lower portion of manifold 108 is permanently covered by lubricating member 307 (see FIG. 5) designed to lower the sliding friction between manifold 108 and slide plate 304. Lubricating member 307 can be made of any convenient material, with ultra high molecular weight (UHMW) polymers being preferred. A preferred material of construction for lubricating member 307 is sold under the trademark Nylatron and consists of a lubricant-impregnated high strength plastic.

At the rear end of slide plate 304 is an upturned ledge 308. Upturned ledge 308 serves to constrain the rear portion of slide plate 304 and to confine it to the area in front of upturned ledge 308.

Located at the leading edge of slide plate 304 is vertical plate 309 which is mounted vertically in lance enclosure 100. Vertical plate 309 contains perforations (not shown) through which lances 126 loosely fit. The perforations in vertical plate 309 are configured so as to reflect the desired lance configuration. For example, in the preferred embodiment vertical plate 309 would have eight holes configured as the eight lances 126 shown in the cross-sectional view of manifold 108 in FIG. 5. The holes in vertical plate 309 are of a diameter which is larger than that of lances 126 so as to enable lances 126 to easily slide through the holes whenever slide plate 304 is stationary while manifold 108, and thus lances 126, are in motion. Vertical plate 309 provides intermediate support for lances 126, reducing the amount by which lances 126 would otherwise sag. Vertical plate 309 also ensures that the upper lances will be no shorter than the lower lances at the point where lances 126 are about to enter tubes to be cleaned. This facilitates the insertion of lances 126 into the tubes.

Located at an intermediate point along slide plate 304 is a pair (only one is shown) of detents 310. Detents 310 are located at a point along slide plate 304 sufficiently forward of upturned ledge 308 to allow just sufficient room for manifold 108 to fit between detents 310 and upturned ledge 308. Detents 310 are adapted to rotate about pin 311. The arms of detents 310 which come in contact with internal walls 103 are rounded off (See FIGS. 10 and 11) to minimize damage to internal walls 103.

The operation of slide plate 304 and detents 310 can be understood with reference to FIGS. 3, 4, 10 and 11. FIG. 3 depicts manifold 108 and slide plate 304 when lances 126 are in their fully retracted position. To drive manifold 108 and thus lances 126 forward, hydraulic motor drive 234 is activated, causing rear sprocket wheels 204 to rotate counterclockwise. As the lower portions of chains 105 is pulled by rear sprocket wheels 204, chains 105 are tightened around front sprocket wheels 202, pulling the top portions of chains 105 forward. This, in turn, pulls manifold 108, which is attached to chains 105 through bracket 400, forward or to the left as shown in FIG. 3. The forward movement of manifold 108 pushes the attached lances 126 forward simultaneously pulling the attached water hose 218 forward. Shown in FIG. 7 is a cross-sectional view of lance enclosure 100 at the front sprocket wheels 202. A pair of sprocket wheels 202, mounted on axes 442 engage a pair of chains 105. Axes 442 are stationary and sprocket wheels 202 are mounted on ball bearings 444. Lances 126 are arranged in a configuration matching the configuration of the tubes in the bundle to be cleaned. In an alternative, and preferred, embodiment of the rear sprocket wheels 202, which is shown in FIG. 12, ball bearings 444 are replaced with needle bearings 445 which can support larger load than ball bearings. Shown also are thrust bearings 447 and grease duct 449.

The forward movement of manifold 108 caused by the driving of chains 105 applies a forward directed force on detents 310 which passes through slide plate 304. This can be seen in more detail in FIG. 10. Thus, for the first portion of its forward travel, manifold 108 causes the forward movement of not only lances 126 and water hose 218 but also of slide plate 304.

Manifold 108 is shaped so that its lower portion is flared outward to form tabs 317. It is these tabs 317 which push against detents 310, forcing slide plate 304 forward. The outwardly extending configuration of tabs 317 ensure that manifold 108 continues to push detents 310.

The forward movement of slide plate 304 continues until the leading edge 305 of slide plate 304 strikes stop plate 306 located near the front end of lance enclosure 100. Stop plate 306 terminates any further forward movement of slide plate 304. At the point when the forward movement of slide plate 304 is stopped by plate 306, detents 310 are located directly above a pair (only one is shown) of slits 312 (see FIG. 1) into which detents 310 are able to rotate. As manifold 108 continues to be driven forward by drive chain 105, the manifold 108 pushes detents 310 causing them to rotate counterclockwise, as shown in FIG. 11, into slits 312. The sliding of detents 310 into slits 312 anchors slide plate 304 in a fixed position. FIG. 11 depicts the position of detents 310 in their anchored configuration. Detents 310 include a ball/spring assembly 314 which stabilizes detents 310 and prevents them from prematurely releasing upon the application of small rear bound forces.

As manifold 108 continues to be driven forward, slide plate 304 now remains stationary while manifold 108 slides forward over the stationary slide plate 304 for the balance of its forward travel. When it is desired to retract lances 126, the direction of the drive sprocket wheels, which preferably are the rear sprocket wheels 204, is reversed. Manifold 108 slides rearward on the stationary slide plate 304 for the first portion of its journey, with detents 310 serving to hold slide plate 304 stationary and preventing any forces which may result from frictional contact between manifold 108 and slide plate 304 from releasing slide plate 304.

When manifold 108 reaches upturned ledge 308 of slide plate 304, the force applied to upturned ledge 308 by manifold 108 is sufficient to release detents 310, causing them to rotate clockwise (as shown in FIG. 11) out of slits 312. In this position, detents 310 no longer restrain the movement of slide plate 304. Further rearward motion of manifold 108 results in the rearward movement of slide plate 304 for the balance of the rearward travel of manifold 108.

Thus, the slide plate 304 results in the complete enclosure at all times of lances 126 which is an important feature of the present invention. The slide plate 304 covers up long slot 320 as the manifold 108 is advanced and retracted.

Referring now to FIG. 8, a long slot 320 parallel to lances 126 and running essentially the entire length of hose enclosure 200 serves to connect hose enclosure 200 and lance enclosure 100 and allows water hose 218 to enter lance enclosure 100 to supply manifold 108 and lances 126 with high pressure water. The presence of slide plate 304 ensures that the slot 320 between hose enclosure 200 and lance enclosure 100 is always covered in the vicinity of lances 126. Thus, the lances 126 will not bend unrestrained into the slot 320. Such a bending of lances 126 could result in the malfunction of and damage to lances 126 and could lead to damage to water hose 218.

It is desirable to locate a number of limit switches (not shown) within lance enclosure 100, typically in slots located at intervals of six to eight in slots in the front and rear portions of lance enclosure 126. Limit switches are used to automatically terminate forward or rearward movement of lances 126 once manifold 108 has reached a predetermined location. This prevents lances 126 from being moved too far out of the tubes to be cleaned and prevents any attempts to insert lances 126 too far into the tubes.

Hose enclosure 200 extends parallel to and below lance enclosure 100, and is shorter in length than the lance enclosure 100. Hose enclosure 200 is wide enough to contain water hose 218 (see FIG. 8). Hose enclosure 200 may be located at any convenient location in proximity to lance enclosure 100, with the position described herein below lance enclosure 100 being preferred. Water hose 218 is connected at one of its ends to a high pressure water source (not shown). Water hose 218 enters hose enclosure 200 near its forward end through a forward coupling 302. Hose enclosure 200 and lance enclosure 100 are connected through a slot 320 (FIG. 8) located at the top of hose enclosure 200, through which water hose 218 enters lance enclosure 100. Slot 320 runs essentially the entire length of hose enclosure 200. The end of water hose 218 is connected through coupling 216 to the rear portion of manifold 108.

As manifold 108 is driven forward in lance enclosure 100, water hose 218 is pulled from hose enclosure 200 and enters lance enclosure 100. Similarly, as manifold 108 is made to travel backward in lance enclosure 100, water hose 218 is pushed out of lance enclosure 100 and made to retract into hose enclosure 200. As can be seen, that portion of slot 320 forward of manifold 108 is always covered by slide plate 304. This prevents lances 126 from entering hose enclosure 200 and prevents water hose 218 from entering lance enclosure 100 at points forward of manifold 108.

With reference to FIGS. 3, 4 and 8, a high pressure water hose 218 is adapted to sealingly mate with manifold 108 at its rear section through coupling 216. Water hose 218 is a semi-rigid high pressure water hose capable of withstanding pressures in excess of 10,000 psi. A typical water pressure hose 218 would be Model 4025 ST, or equivalent, manufactured by Rogan-Shanley, Inc. of Houston.

Referring now to FIGS. 5 and 6, manifold 108 is comprised of a central metal body 110 having an axial bore 112 therethrough. One end of bore 112 is adapted to be removably connected to a high pressure water line 218 through coupling 216. It is understood that any references to water as a high pressure cleaning fluid are meant to include water, a cleaning fluid, or any combination of water and a cleaning fluid. Body 110 includes a sealing thread 114 in central bore 112. Opposite the threaded end of body 110, a coaxial counterbore 116 is machined in bore 112. A lance plate 118 is mounted adjacent to the machined counterbore 116 and in sealing contact with body 110. Lance plate 118 may be maintained adjacent to manifold body 110 by means of drilled and tapped holes or other suitable mechanical means. The lance plate 118 further includes internal threads (not shown) adapted to receive lances 126 and mate with threads 128 thereon.

Lances 126 are removably attached and in fluid communication with manifold 108. Lances 126 have relatively thin walls and are manufactured from a high strength stainless steel or other suitable material. Lances 126, when mated with manifold 108, are approximately the length of housing 102. The lance enclosure 100 further includes an indexing assembly 131. The structure and operation of an exemplary indexing assembly is disclosed in U.S. patent application Ser. No. 490,776.

The apparatus of the present invention can accommodate lances 126 of various lengths. To accomplish this, lance enclosure 100 is extendable through the insertion of additional enclosure section. This is done at the flanges 313 (FIGS. 3, 4 and 5). Whenever it is desired to lengthen flange enclosure 100 so as to accommodate longer lances 126, it is possible to unbolt flanges 313 and insert an additional lance enclosure section (not shown) along with longer chains 105 and longer lances 126. Some details of flange 313 can be seen in FIG. 5. The flange is typically made of aluminum and is reinforced by the use of a number of gussets 315.

Lances 126 are driven forward and backward by driving manifold 108 to which lances 126 are connected backwards and forwards. This is accomplished by driving chains 105 which are connected to the manifold 108 through bracket 400 at the top of manifold 108. Chains 105 are driven by rotating front sprocket wheels 202 or rear sprocket wheels 204, or both. It is preferred to drive rear sprocket wheels 204 since this makes the front end of the apparatus lighter and more maneuverable and since pulling the bottom portion of chains 105 ensures that there will be no slack chain in the immediate vicinity of the lances during the advancement of lances 126 into the heat exchanger tubes when the tubes are under most stress. The presence of slack in the vicinity of lances 126 during lance insertion could result in malfunction of the apparatus.

Various means can be used to drive rear sprocket wheels 204. It is preferred to use hydraulic drive. Referring to FIGS. 3 and 4, when hydraulic drive motor 234 is activated, rear sprocket wheels 204 pull the bottom portion of chains 105, thereby pulling manifold 108 forward. Reversing directions, rear sprocket wheels 204 pull the top portion of chains 105 and thus manifold 108 backwards. Hose 218 travels out of hose enclosure 200 and into lance enclosure 100 wherein it is removably connected to manifold 108. Thus, lances 126, manifold 108 and hose 218 are in fluid communication with each other.

OPERATION OF THE PRESENT INVENTION

Because of the large weight and size of heat exchanger tube bundles, it is often necessary to clean the tube bundles on site. Accordingly, it is necessary to transport the apparatus according to the present invention to a job site for operations. The present invention including lance enclosure 100, hose enclosure 200, and positioning assembly 300 may be transported to the job site by any suitable means. It is contemplated that the present invention will be transported to a job site on a trailer as disclosed in U.S. patent application Ser. No. 489,001. Further, while the present invention may be used in conjunction with any high pressure, high volume fluid source, it is contemplated that the present invention will be used in conjunction with the invention disclosed and claimed in U.S. patent application Ser. No. 489,001.

Upon arriving at the job site, the positioner assembly 300 is removed from the trailer (not shown) by means of a crane assembly as disclosed in U.S. patent application Ser. No. 489,001, and positioned normal to the end of a tube bundle "B" to be cleaned. The remote control pendant (not shown) is removed from its transport vehicle and positioned to permit the operator to direct and observe lancing operations while maintaining a safe distance from the high pressure lances. The lance housing 100 and hose enclosure 200 are mounted onto the positioner 300 utilizing a suitable lifting and placement means, such as the crane disclosed in U.S. patent application No. 489,001 or any other suitable means. The lance enclosure 100 and hose enclosure 200 are then secured to the positioner 300. The operator inspects the tube bundle spacing and selects the forward guide plate (not shown) which best corresponds with the tube bundle size and spacing. A flexible hydraulic hose (not shown) is used to interconnect the hydraulic drive motor 234 with a suitable hydraulic pressure source. The lances 126 are in fluid communication with a high pressure water source (not shown) by means of hose 218 which is connected to manifold 108 through coupling 216. Lance enclosure 100 and hose enclosure 200 are then positioned with respect to the tube bundle tubes by the selective application of hydraulic pressure to the positioning motors (not shown) of positioner 300. Hydraulic pressure to hydraulic drive motor 234 drives rear sprocket wheels 204 thus driving chains 105 which are connected to manifold 108 through bracket 400. Hydraulic drive motor 234 thus causes manifold 108 with its attached lances 126 to move alternately forwards or backwards. The movement of manifold 108 causes water hose 218, which is connected to manifold 108 to move forwards and backwards. This movement of manifold 108 causes water hose 218 to alternately deploy into lance enclosure 100 and retract into hose enclosure 200.

Lances 126 alternately advance out of and retract into lance enclosure 100. Lances 126 are indexed to the proper centerlines for individual tubes within tube bundle "B" when the lances exit forward guide plate (not shown) and enter tube bundle "B." The high pressure water source is activated by the operator causing high pressure water to flow through hose 218, into manifold 108, and out lances 126 into the individual tubes. Lances 126 continue to advance into the tubes, cleaning deposits away from the inside. Should one of lances 126 encounter an obstruction it is unable to clean away, the excess water pressure will be channeled into remaining lances 126 through manifold 108 counterbore 116. Further, a commercial needle valve (not shown) may be placed in the hydraulic line powering hydraulic motor 234 to limit hydraulic pressure. When a lance 126 encounters an obstruction, if the water pressure or the forward motion of lance 126 does not dislodge the obstruction, the needle valve will prevent the hydraulic pressure of motor 234 from increasing. By limiting the pressure, the apparatus according to the present invention prevents lances 126 from buckling when attempting to clear the obstruction. It will be appreciated that the fact that lances 126 are tightly packed and are totally enclosed within a very small cross-sectional area, with no possibility of bending to a large extent prior to encountering a confining surface, makes it possible to impose larger thrust forces on lances 126 than has been heretofore possible. The application of larger forces renders the cleaning operations more efficient.

The present invention, when used in conjunction with suitable means for supporting and rotating tube bundle "B," such as that disclosed in U.S. patent Application Ser. No. 489,001, is thus capable of cleaning the interior of all tubes within a tube bundle by positioning the lances vertically and horizontally. Further, a single operator is capable of positioning lance enclosure 100 and hose enclosure 200 and controlling the water flow from a remote control pendant. Thus, a single operator is capable of carrying out multi-lance cleaning operations.

Further, the apparatus of the present invention may be used independently of positioning and support assembly 300. It is contemplated that lance enclosure 100 and hose enclosure 200 may be lifted and positioned vertically, by a crane, frame, or other suitable mechanical means, permitting lances 126 to project downward as they are advanced within lance enclosure 100. Thus, lance enclosure 100 and hose enclosure 200 may be used to clean tube bundles which, for reasons of size or weight, must be cleaned in a vertical position.

The descriptions given herein are intended to illustrate the preferred and alternative embodiments of the apparatus according to the present invention. It is possible for one skilled in the art to make various changes to the details of the apparatus without departing from the spirit of this invention. Therefore, it is intended that all such variations be included within the scope of the present invention as claimed.

What is claimed is:

1. A multi-lance cleaning apparatus for cleaning the interior of heat exchanger tubes, comprising:

(a) an elongate housing having front and rear ends;

(b) a manifold slidably moveable within said housing, said manifold having a plurality of interconnected channels and outlets;

(c) a conduit for connecting said manifold with a high pressure fluid source;

(d) a plurality of hollow tubular lances, the outer diameter of each of said lances being adapted to fit within a single heat exchanger tube, each said lance having a front end and a rear end, said rear end of each said lance being removably attached to said manifold and in communication with said fluid source;

(e) an enclosure for storing said conduit to permit said conduit to advance and retract, said enclosure being parallel to and in close proximity to said housing, and communicating with said housing through an opening;

(f) means for covering portions of said opening adjacent to said lances;

(g) means for alternately moving said manifold within said housing toward said front end of said housing and toward said rear end of said housing;

(h) means for supporting and guiding the movement of said lances; and (i) means for supporting and positioning said housing and said lances with respect to the heat exchanger tubes to be cleaned.

2. The apparatus according to claim 1, wherein said conduit is a semi-rigid, high pressure hose having two ends, one end of said hose being adapted to be removably connected to said manifold, and the other end of said hose being adapted to be removably connected to a high pressure, high volume fluid source.

3. The apparatus according to claim 1, wherein said enclosure is located below said housing.

4. The apparatus according to claim 1, wherein said enclosure is located above said housing.

5. The apparatus according to claim 1 wherein said housing includes means for accessing said lances and said manifold.

6. The apparatus according to claim 1, wherein said means for moving said manifold, includes:

a motor; and means for coupling the output of said motor to said manifold.

7. The apparatus according to claim 6 wherein said motor is a hydraulic motor.

8. The apparatus according to claim 6 wherein said means for coupling the output of said motor to said manifold, includes:

a chain;

means for coupling the output of said motor to said chain; and means for coupling said chain to said manifold.

9. The apparatus according to claim 1, wherein said means for supporting and guiding comprises:

a first guide plate having a plurality of apertures adapted to support said lances, said first guide plate being interposed proximate to said front end of said housing;

a plurality of guide tubes, said guide tubes being removably attached to said first guide plate and radially offset from said first guide plate to permit said lances to pass therethrough; and a second guide plate having a plurality of apertures corresponding to the tube bundle to be cleaned and adapted to be removably mounted on said second end of said elongate housing.

10. The apparatus according to claim 1 wherein said covering means is a slide plate.

11. The apparatus according to claim 10 wherein said slide plate supports said manifold.

12. The apparatus according to claim 11 wherein said slide plate includes an upturned ledge and a detent.

13. A multi-lance cleaning apparatus for cleaning the interior of heat exchanger tubes, comprising:

(a) an elongate rectangular hollow housing having front and rear ends;

(b) a hollow manifold slidably moveable within said housing, said manifold having a plurality of interconnected channels and outlets;

(c) a semi-rigid high pressure hose adapted to removably connect said manifold with a high pressure, high volume fluid source;

(d) an enclosure for storage of said hose to permit said hose to advance and retract wherein said enclosure communicates by way of a slot with said housing;

(e) sliding plate for covering that portion of said slot located forward of said manifold;

(f) a plurality of hollow tubular lances, the outer diameter of each of said lances being adapted to fit within a heat exchanger tube, said lance having a front end and a rear end, said rear end being removably attached to said manifold and in communication with said fluid source; and (g) means for supporting and positioning said housing and said lances with respect to the heat exchanger tubes to be cleaned.

14. The apparatus according to claim 13 wherein said apparatus further includes means for supporting and guiding the movement of said lances within said housing.

15. The apparatus according to claim 14 wherein said means for supporting and guiding comprises:

a first guide plate having a plurality of apertures adapted to support said lances, said first guide plate being interposed proximate to said front end of said housing;

a plurality of guide tubes, said guide tubes being removably attached to said first guide plate and radially offset from said first guide plate to permit said lances to pass therethrough; and a second guide plate having a plurality of apertures corresponding to the tube bundle to be cleaned and adapted to be removably mounted on said second end of said elongate housing.

16. The apparatus according to claim 13 wherein said slide plate supports said manifold and includes an upturned ledge and a detent.

17. A multi-lance cleaning apparatus for cleaning the interior of vertically oriented heat exchanger tubes comprising:

(a) elongate hollow housing having front and rear ends;

(b) a hollow manifold slidably moveable within said housing, said manifold having a plurality of interconnected channels and outlets;

(c) a conduit for connecting said manifold with a high pressure fluid source;

(d) an enclosure for storing said conduit to permit said conduit to advance and retract, said enclosure being in close proximity to said rear end of said housing;

(e) means for alternately moving said manifold within said housing toward said front end of said housing and toward said rear end of said housing;

(f) a plurality of hollow tubular lances, the outer diameter of each said lance being adapted to fit within a heat exchanger tube, said lance having a front end and a rear end, said rear end of each of said lances being attached to said manifold and in communication with said fluid source;

(g) means for supporting and guiding the movement of said lances; and (h) means for vertically suspending said housing and enclosure above the heat exchanger tubes, such that said lances may be selectively advanced down into the heat exchanger tubes.

18. The apparatus according to claim 17, wherein said conduit is a semi-rigid, high pressure hose having two ends, one end of hose being adapted to be removably connected to said manifold, and the other end of said hose being adapted to be removably connected to a high pressure, high volume fluid source.

19. The apparatus according to claim 17, wherein said elongate housing further includes a support member mounted thereto.

20. The apparatus according to claim 17 wherein said means for vertically suspending said housing and enclosure above the heat exchanger tubes includes a mobile crane.

* * * * *